US005136924A

United States Patent [19]

Förster et al.

[11] Patent Number: 5,136,924

[45] Date of Patent: Aug. 11, 1992

[54] SILENCER FOR FIREARMS

[75] Inventors: Theobald Förster, Jestetten, Fed. Rep. of Germany; Peter Goepfert, Bonstetten, Switzerland

[73] Assignee: SIG Schweizerische Industrie-Gesellschaft, Neuhausen am Rheinfall, Switzerland

[21] Appl. No.: 638,324

[22] Filed: Jan. 7, 1991

[30] Foreign Application Priority Data

Jan. 26, 1990 [CH] Switzerland ..... 00250/90

[51] Int. Cl.[5] ..... F41A 21/30

[52] U.S. Cl. ..... 89/14.4

[58] Field of Search ..... 89/14.4, 14.5, 14.3, 89/14.2

[56] References Cited

U.S. PATENT DOCUMENTS

| | | | |
|---|---|---|---|
| 953,943 | 4/1910 | Childress | 89/14.4 |
| 955,694 | 4/1910 | Riggs | 89/14.4 |
| 956,717 | 5/1910 | Moore | 89/14.4 |
| 959,400 | 5/1910 | Stinson | 89/14.4 |
| 984,750 | 2/1911 | Craven | 89/14.4 |
| 1,021,742 | 3/1912 | Moore | 89/14.4 |
| 1,143,814 | 6/1915 | DeVries | 89/14.4 |
| 1,171,242 | 2/1916 | Prather | 89/14.4 |
| 1,207,264 | 12/1916 | Bailey | 89/14.4 |

*Primary Examiner*—David H. Brown

*Attorney, Agent, or Firm*—Bachman & LaPointe

[57] ABSTRACT

A silencer for use with pistols with a fixed or tilting barrel. The design configuration is such that the sighting line is retained when the silencer is fitted. Handleability of the weapon is not seriously adversely affected by the design configuration and the lightweight structure.

14 Claims, 3 Drawing Sheets

SILENCER FOR FIREARMS

BACKGROUND OF THE INVENTION

The invention relates to a silencer for firearms, in particular for hand guns.

Silencers are known for firearms, in particular hand guns. In the case of firearms in which the gases issue from the muzzle of the barrel at supersonic velocity, use is made of so-called chamber silencers in which the powder gases are passed through successively disposed chambers which are formed by means of partitions in a silencer housing, the partitions having through openings for the gases to pass therethrough. In comparison, silencers for firearms in which the powder gases leave the firearm at a velocity in the sub-sonic range are generally provided with what are known as turbulence chambers.

Silencers of the above-discussed configuration are generally not an integral part of a weapon but are connected to a weapon, as a separate part, for use thereof in the appropriate fashion. It is known for silencers to be screwed on the barrel of weapons by means of a screwthread. It is also known for the silencer to be fitted on to the barrel and for the latter to be mounted on the casing of a weapon. The known silencers which can be fitted by being screwed on or by being pushed on are in the form of cylindrical bodies of larger diameter than the barrel muzzles, increased by the height of a front sight . The result of that is that an end face of the silencer covers the front sight and thus renders inoperative the aiming system which is disposed on the weapon and which comprises a front sight and a rear sight. In order to overcome that deficiency, it is known to provide auxiliary sighting devices which comprise a rear sight and a front sight disposed on the silencer.

U.S. Pat. No. 4,479,418 discloses a silencer which can be fitted on to the barrel muzzle of a hand gun, a pistol, with a movable barrel, comprising a silencer housing of a cylindrical configuration and a holding device connected to the silencer housing for connecting the silencer to the pistol. The holding device comprises a limb portion which is connected to the silencer housing at one end and which at its free end carries two arms, between which the pistol casing is received. The limb portion carries a guide pin which extends parallel to the axis of the barrel and which, when the silencer is fitted on to the gun, that is to say the muzzle of the barrel is accommodated in a corresponding aperture in the silencer, extends into a bore which opens out at an end face of the pistol casing. The arms extend from the limb portion to the trigger safety guard and are provided at that end with bores which extend in alignment with a bore in the trigger safety guard. The bores extend transversely with respect to the axis of the barrel and receive a safety pin which secures the arms to the safety guard. The known silencer suffers from the disadvantage that the cylindrical silencer housing with the trajectory for the projectile extending therein in concentric relationship with the axis of the silencer housing projects with an end thereof beyond the front sight disposed on the pistol casing so that the silencer has to be provided with an auxiliary aiming device. Auxiliary aiming devices disposed on a silencer involve the disadvantage that their sighting line is not in the same precise position relative to the axis of the barrel as the sighting line which is formed by the rear sight and the front sight disposed on the body of the pistol. Silencers of that known kind are subjected in use to thermal loadings which result in constant deformation of the silencer housing and thus contribute to further worsening the position of the sighting line.

In order to achieve a satisfactory silencer effect, silencers are to be designed with cylindrical silencer housings which are relatively long in relation to the length of the pistol body, but at least as long as the spacing of the front sight and the rear sight on the pistol body, so that it is possible to maintain a spacing of substantially the same length between the front sight and the rear sight of the auxiliary aiming device. As a result, a pistol provided with a silencer of that kind suffers from a change in the position of its center of gravity, which is important from the point of view of comfort and convenience of use of the pistol; furthermore, when firing a shot with the known design configuration, due to the long lever arm between the muzzle of the barrel and the guide pin, high moments are produced, which are not adequately carried by the guide pin and the safety pin so that the mounting of the silencer on the pistol does not comply with the requirement in respect of rigidity.

SUMMARY OF THE INVENTION

Taking the foregoing as his basic starting point, the inventor set himself the object of providing a silencer for firearms, in particular hand guns, for example pistols, which, when mounted to a pistol barrel, does not cover the sighting line formed by a rear sight and a front sight disposed on the pistol body, and in which the means for mounting same to a pistol body is of such a configuration that the mounting means can be easily brought into engagement with the pistol body and mounts the silencer rigidly to the casing of the pistol. That object is achieved in accordance with the invention.

The present invention comprises a silencer for fitting to hand guns, in particular pistols, comprising a closed silencer housing formed from a peripheral wall and first and second end walls arranged at a spacing from each other, with a center line extending in the longitudinal direction of the silencer housing, and entry opening into the silencer housing, which is provided in the first end wall and which receives a front open end of a barrel of a hand gun, and a discharge opening from the silencer housing, which is arranged in the second end wall, the longitudinal axes of the entry and discharge openings being arranged to extend in aligned extension relative to the longitudinal axis of the barrel through the end walls, and further comprising a means for mounting the silencer housing to a hand gun, characterized in that the longitudinal axes of the entry opening and the dishcarge opening are arranged eccentrically relative to the center line of the silencer housing and are at a spacing from an outside surface of the peripheral wall, which is equal to or less than the spacing between the longitudinal axis of the barrel and a base of a front sight disposed at the front end of a hand gun.

Due to the eccentric arrangement of the longitudinal axes of the entry and discharge openings relative to the center line of the silencer housing, wherein the spacing of the longitudinal axes of the entry and discharge openings relative to the outer peripheral surface of the silencer housing is equal to or smaller than the spacing between the longitudinal axis of the barrel of a pistol and the base of a front sight disposed on the pistol body, it is provided that the sighting line formed by the aiming device on the pistol body is not covered over, and the disadvantages of the auxiliary aiming devices arranged on silencers of the known kind are thus eliminated. In addition, by virtue of the eccentric relationship between the longitudinal axes of the entry opening and the discharge opening, and the center line of the silencer it is made possible for the silencer chamber volumes which are required to provide an adequate reduction in acoustic pressure to be arranged perpendicularly below and not in alignment with the longitudinal axis of the barrel as in the state of the art, thereby making it possible to provide silencers which are shorter in the direction of the barrel and which are also lighter when choosing a suitable material, for example aluminum, and that has a lesser effect on the position of the center of gravity of the hand gun provided with the silencer designed in accordance with the invention.

Advantageous configurations of the invention are set forth hereinbelow.

BRIEF DESCRIPTION OF THE DRAWINGS

Further advantages, features and details of the invention will be apparent from the following description of a preferred embodiment and the drawing in which.

DETAILED DESCRIPTION

Figure 1:
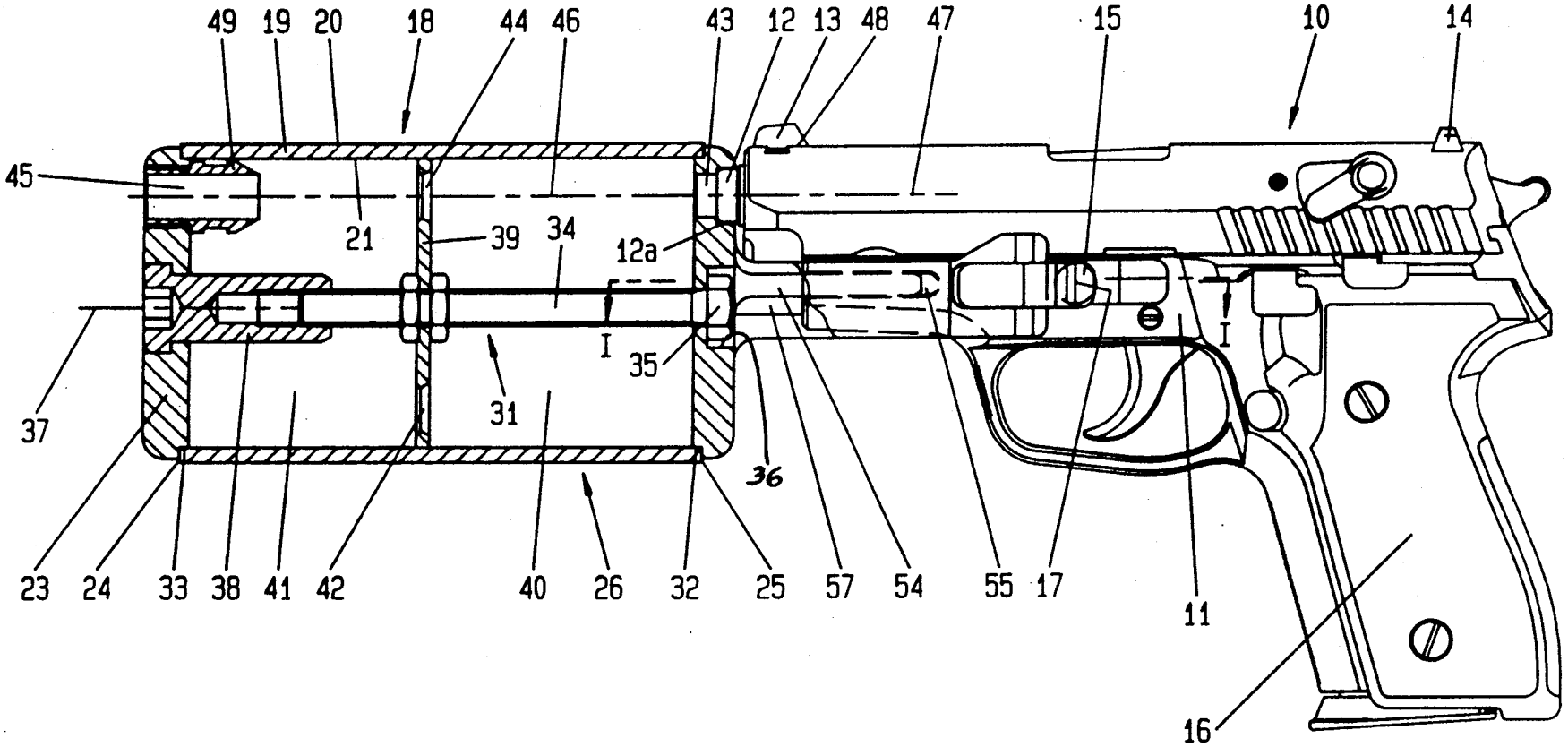
FIG. 1 is a sectional side view of a pistol with a silencer fitted thereto.

FIG. 1 is a side view of a pistol 10 having a casing 11 in which a barrel 12 of fixed or movable design configuration is accommodated. The casing carries an aiming device formed by a front sight 13 and a rear sight 14. Reference numeral 15 denotes a tube or barrel holding pin which has an abutment surface 17 on its side which is towards the butt 16 of the pistol 10.

Figure 3:
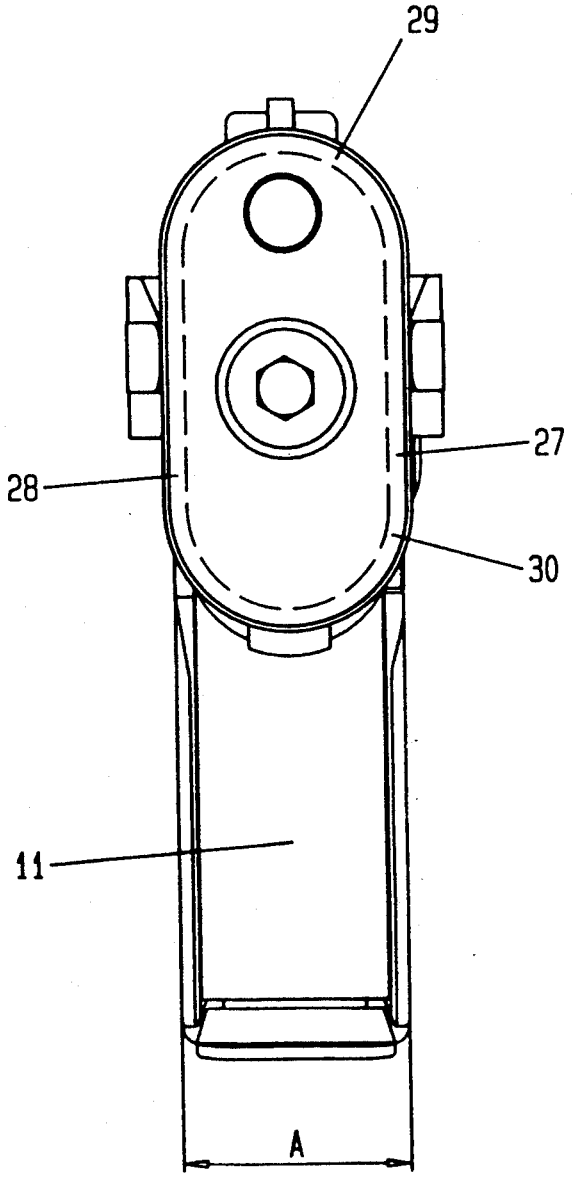
FIG. 3 is a front view of a pistol with silencer fitted thereto.

The silencer 18 comprises a peripheral wall 19 with an outer peripheral surface 20 and an inner peripheral surface 21. The peripheral wall 19 is closed at the open ends 24, 25 thereof by a first end wall 22, hereinafter referred to as the bottom portion 22, and a second end wall 23, hereinafter referred to as the front portion 23, which are arranged at an axial spacing from each other, so that the peripheral wall 19 with bottom portion 22 and front portion 23 form a closed silencer housing 26. The silencer housing 26 may be of polygonal configuration in cross-section, including circular, elliptical or rectangular. As shown in FIG. 3, the silencer housing 26 is of such a configuration that its peripheral wall 19 comprises two peripheral wall portions 27, 28 which extend perpendicularly and parallel in spaced-apart relationship and which are connected together by means of two arcuate peripheral wall portions 29, 30 and which are closed by a fron portion 23 and a bottom portion 22 of a corresponding configuration. In that embodiment, the spacing between the peripheral wall portions 29 and 30 is preferably to be of such a size that it approximately corresponds to the width A of the casing 11. With that dimension, the width of the pistol 10 is not increased when the silencer 18 is fitted thereto; that contributes to manageability of the weapon and to a lower level of requirement for storage and transportation space.

The front portion 23 and the bottom portion 22 are in releasable engagement with the peripheral wall 19 insofar as the front portion 23 and the bottom portion 22 are screwed towards each other by means of a screw device 31 which passes through the silencer housing 26. For the purposes of centering the bottom portion 22 and the front portion 23 at the free ends 25 and 24 of the peripheral wall, the bottom portion 22 and the front portion 23 are provided with stepped recesses 32 and 33 over which engage the free ends 24 and 25 of the peripheral wall 19.

The screw device 31 comprises a screw 34 having a head 35 which is accommodated in a recess 36 in the bottom portion 22. The screw 34 passes through the silencer housing 26 along the center line 37 which represents the center line 37 of the silencer housing 26. At its front end the screw 34 engages into a nut 38 which is rotatably mounted to the front portion 23. Provided on the screw 34 at a central spacing between the front portion 23 and the bottom portion 22 is a partitioning wall 39 which corresponds in its outer periphery to the internal cross-section of the silencer housing 26 and which divides the interior of the silencer housing 26 into two silencer chambers 40 and 41 which communicate with each other for the transmission of gases by way of at least one through opening 42 in the partitioning wall 39. For the purposes of cleaning the silencer 18, the nut 38 is disengaged from the screw 34, whereby the front portion 23 and the bottom portion 22 can be removed from the peripheral wall 19, with the partitioning wall 39 being pulled out at the same time.

The bottom portion 22 is provided with an entry opening 43, the partitioning wall 39 is provided with a through opening 44 and the front portion 23 is provided with a discharge opening 45; the longitudinal axis of the openings 43, 44 and 45 extends in aligned extension with respect to the longitudinal axis 47 of the barrel 12. The entry opening 43, the through opening 44 and the discharge opening 45 are of a slightly larger diameter than the barrel 12 so that a projectile issuing from the barrel 12 can pass unimpededly through the openings. The spacing of the center line 46 relative to the outer peripheral surface 20 of the peripheral wall 19 is equal to or less than the spacing between the center line 47 of the barrel 12 relative to the base 48 of the front sight 13 so that the silencer 18 does not cover the sighting line formed by the front sight 13 and the rear sight 14.

The entry opening 43 is in the form of a blind bore, with the front end of the barrel 12 being accommodated in the bored-out portion, that is to say the portion 12*a*. The bored-out portion 12*a* has a slight oversize in comparison with the diameter of the barrel 12 so that the barrel 12 is slidably movable in the bored-out portion 12*a*. The depth of the bored-out portion is so selected that, in the case of a drop or tilting barrel weapon, in the recoil movement the barrel 12 comes out of the bored-out portion 12*a* as soon as the tilting movement begins. The discharge opening 45 accommodates what is referred to as a Borda's mouthpiece 49.

Figure 2:
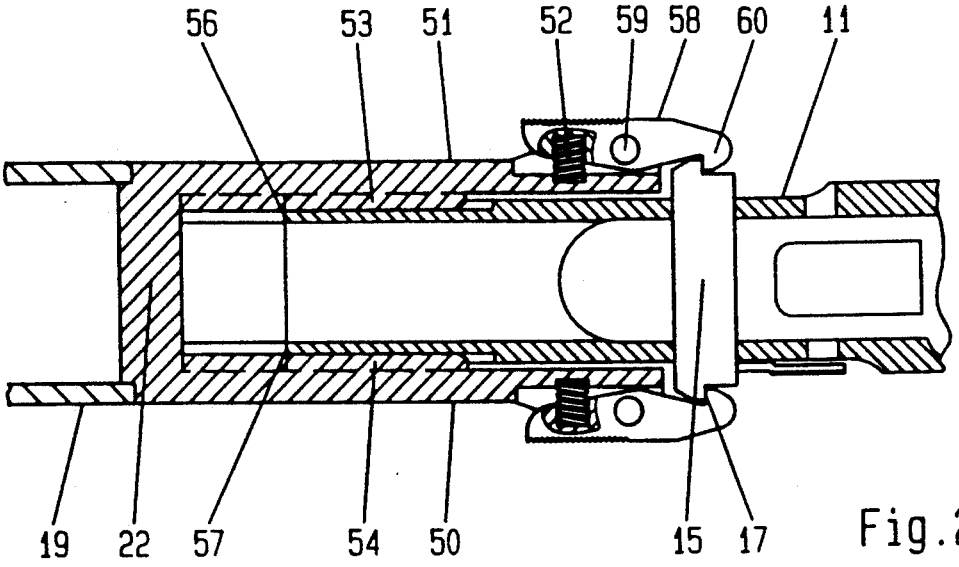
FIG. 2 is a plan view in section taken along section line I—I in FIG. 1.

As shown in FIG. 2 the bottom portion 22 carries two arms 50 and 51 which extend in the direction of the barrel or tube holding pin 15. The arms 50 and 51 comprise between them an internal spacing which is somewhat greater than the width of the casing 11 of the pistol 10. Provided at the respective mutually facing surfaces of each of the arms 50 and 51 are bars 53 and 54 which can be fitted into grooves 55 in the casing 11 (FIG. 1). Provided on the bars 53 and 54 are abutment noses 56 and 57 which butt against the casing 11 and which in their longitudinal extent determine the mounting spacing between the silencer 18 and the casing 11.

At their front ends the arms 50 and 51 each carry a respective arresting lever 58. The arresting lever 58 is mounted pivotably about a pin 59. A compression spring 52 acts on the arresting lever 58 at one end. The other end of the arresting lever 58 is of a hook-like configuration. The hook 60 engages behind the abutment surface 17 on the holding pin 15 and thus secures the silencer 18 to the casing 11.

Figure 4:
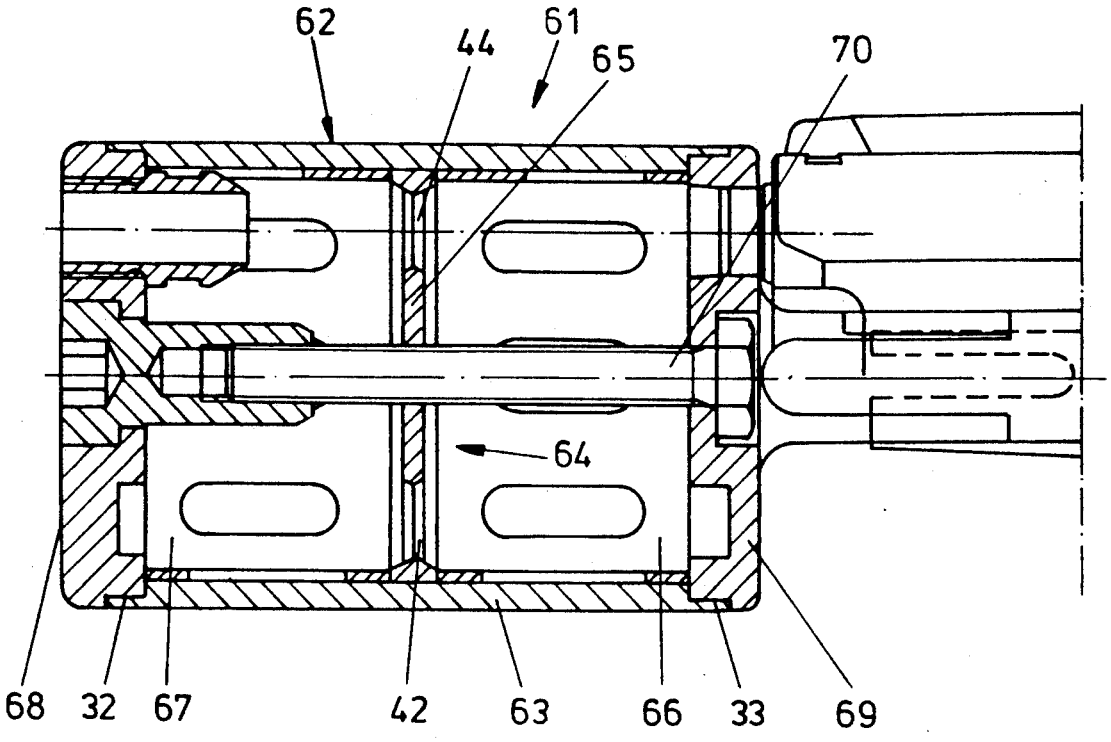
FIG. 4 is a sectional view of a further embodiment of a silencer.

FIG. 4 is a view in longitudinal section of a silencer 61 in which the hollow-cylindrical silencer housing 62 is of a circular configuration in cross-section. Except for the circular peripheral wall 63 and bottom portion 69 and front portion 68 of corresponding shape, and a different arrangement 64 for holding the partitioning wall 65 in position, the silencer 61 generally has the same structural and functional features as the above-described silencer 18. The arrangement 64 for holding the partitioning wall 65 in position involves two round sleeves 66 and 67 which bear in the silencer housing 62 against the inside of the peripheral wall 63 and which at one end each hold the partitioning wall 65 between them, while at their other ends the sleeve 66 is supported against the bottom portion 69 and the sleeve 67 is supported against the front portion 68. In this embodiment the screw 70 passes through the partitioning wall 65 so that when the silencer 61 is opened, the partitioning wall 65 and the sleeves 66 and 67 are individually removable from the housing 62 for easier cleaning.

The silencer 18 can be easily fitted to the pistol 10. For that purpose it is only necessary to introduce the bars 53 and 54 into the grooves 55, pivot the arresting lever 58 in opposite relationship to the direction in which the compression spring 52 acts, and latch the hooks 60 to the abutment surfaces 17 of the barrel holding pin 15. Dismantling is effected in the reverse sequence.

We claim:

1. A hand gun-silencer combination comprising: a hand gun having a gront sight disposed at the front end of the hand gun and having a barrel; a closed silencer housing defined by a peripheral wall having an outside surface and first and second end walls arranged at a spacing from eath other, said first and second walls being disposed entirely forwardly of said front sight, with a center line extending in the longitudinal direction of the silencer housing; an entry opening into the silencer housing having a longitudinal axis, said entry opening provided in the first end wall operative to receive a front open end of said barrel; a discharge opening from the silencer having a longitudinal axis, said discharge opening arranged in the second end wall, wherein the longitudinal axes of the entry and discharge openings are arranged to extend in aligned extension relative to a longitudinal axis of the barrel received in the front open end; means for mounting the silencer housing to the hand gun including arms extending from said first end wall into engagement with said hand gun; and wherein the longitudinal axes of the entry opening and the discharge opening are arranged eccentrically relative to the center line of the silencer housing and are at a spacing from an outside surface of the peripheral wall which is equal to or less than the spacing between the longitudinal axis of the barrel and a base of the front sight.

2. A combination according to claim 1 wherein the silencer housing has an annular confituration.

3. A combination according to claim 1 wherein the silencer housing compriser two peripheral wall portions which extend in parallel relationship at a spacing from each other and which are connected together by means of arcuate peripheral wall portions.

4. A combination according to claim 1 wherein the discharge opening is formed by a Borda3 s mouthpiece which projects into the interior of the silencer housing and which has a slightley larger inside diameter than the diameter of the bore of the barrel.

5. A combination according to claim 1 wherein the end fo the barrel is accommodated with slight clearance between a peripheral wall of the barrel end and a peripheral wall of a bored-out portion of the entry opening.

6. A combination according to claim 5 wherein the front end of the barrel is accommodated in an axial extent in the bored-out portion, which corresponds at least to the recoil travel of the barrel with or without a drop barrel.

7. A combination according to claim 1, wherein said arms include two arms arranged at the first end wall which are disposed in mutually opposite and spaced apart relationship, with bars disposed on the arms, wherein the bars are designed to be introduced into grooves on the hand gun casing.

8. A comgination according to claim 7, including a barrel holding pin wherein said arms at their free ends, which are towards said barrel holding pin, have arresting levers with hooks, which arresting levers are pivotable about a pin by means of springs.

9. A combination according to claim 8 wherein the barrel holding pin includes abutment surfaces and wherein the hooks cooperate with the hand gun casing and are brought into engagement with said abutment surfaces.

10. A conbination according to claim 1 wherein the silencer housing includes at least two chambers formed by a partitioning wall disposed in the silencer housing, wherein the partitioning wall has at least one through opening for the transmission of the gases from one chamber into the other and an aperture for a projectile to pass therethrough.

11. A combination according to claim 10 wherein the partitioning wall is accommodated between two sleeves which are respectively supported against the first and second end walls.

12. A combintaion according to claim 10 wherein said first and second walls of the housing are releasably in engagement together with the peripheral wall.

13. A combination according to claim 12 wherein the peripheral wall bears against stepped, mutually oppositely disposed recesses on the first end wall and the second end wall, and wherein the first and second end walls are screwed relative to each other by means of a screw device which passes thorugh the silencer housing.

14. A combination according to claim 13 wherein the partitioning wall is arranged at the screw device.

* * * * *